US010805732B2

(12) United States Patent
Inoue et al.

(10) Patent No.: US 10,805,732 B2
(45) Date of Patent: Oct. 13, 2020

(54) DIAPHRAGM OR DUST CAP AND SPEAKER UNIT

(71) Applicant: Onkyo Corporation, Osaka (JP)

(72) Inventors: Takeru Inoue, Osaka (JP); Hajime Yoshimura, Osaka (JP); Hiroyasu Kumo, Osaka (JP); Sadatoshi Hisamoto, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 16/531,095

(22) Filed: Aug. 4, 2019

(65) Prior Publication Data

US 2020/0077197 A1 Mar. 5, 2020

(30) Foreign Application Priority Data

Aug. 31, 2018 (JP) ..... 2018-162233

(51) Int. Cl.
*H04R 9/06* (2006.01)
*H04R 7/12* (2006.01)
*H04R 9/02* (2006.01)

(52) U.S. Cl.
CPC ..... *H04R 7/127* (2013.01); *H04R 9/025* (2013.01); *H04R 9/06* (2013.01); *H04R 2307/025* (2013.01); *H04R 2400/11* (2013.01)

(58) Field of Classification Search
CPC ..... H04R 7/14; H04R 7/127; H04R 9/025; H04R 9/06; H04R 2307/025; H04R 2400/11
See application file for complete search history.

(56) References Cited

U.S. PATENT DOCUMENTS 3,669,214 A * 6/1972 Matsuura ..... H04R 7/06 181/164
2005/0078850 A1* 4/2005 Norton ..... H04R 7/14 381/423

FOREIGN PATENT DOCUMENTS

JP 62-026997 U1 2/1987
JP 4968139 B 7/2012

OTHER PUBLICATIONS

Syunsuke Kudo, Motomu Uno, and Yosuke Tanaka, "Morphological Characteristics of Vein of Dragonfly and Its Potential of Architectural Applications," (Summaries of Technical Papers of Annual Meeting by Architectural Institute of Japan, Summaries of Design Works of Annual Meeting, vol. 2012, p. 5324) (Discussed in Specification).

(Continued)

*Primary Examiner* — Brian Ensey

(57) ABSTRACT

There is provided a diaphragm or a dust cap configured to emit a sound wave and an electrodynamic speaker unit including the diaphragm or the dust cap. The speaker unit is configured so that a great peak dip of sound pressure frequency characteristics due to influence of a divided vibration mode can be prevented and excellent reproduced sound quality can be provided. In the diaphragm or the dust cap, a recessed-raised portion imitating a wing of an insect is formed at least on one surface of a diaphragm portion configured to emit a sound wave. Preferably, the recessed-raised portion is formed based on data obtained by measurement of an actual shape of a wing vein of the insect or data of a Voronoi diagram imitating the wing vein of the insect.

6 Claims, 5 Drawing Sheets

(56) References Cited

OTHER PUBLICATIONS

Yuri Nakagawa, Ayane Hamano, and Mizuki Yamada, "Reasons why Dragonfly Wing Veins Show Voronoi Structure," (Hiroshima University High School), Date Unknown, (Discussed in Specification).

* cited by examiner

10
S
A
A
O
11
12
13
14
15
Sec. A-A 20
22
24
25
23
A
A
O
Sec. A-A

DIAPHRAGM OR DUST CAP AND SPEAKER UNIT

BACKGROUND OF THE INVENTION

1. Field of the Invention

The present invention relates to a diaphragm or a dust cap configured to emit a sound wave and an electrodynamic speaker unit including the diaphragm or the dust cap.

2. Description of the Related Art

In an electrodynamic speaker unit, an assembly structure in which an inner peripheral end of a speaker diaphragm (specifically, a cone diaphragm) is, with an adhesive, bonded to a cylinder side surface of a cylindrical voice coil bobbin is often used. In an electrodynamic speaker, audio signal current is supplied to a coil wound around the voice coil bobbin. An edge is coupled to an outer diameter portion of the cone diaphragm, an outer peripheral end side of the edge is fixed to a frame coupled to a magnetic circuit, and a coil of a voice coil is arranged in a magnetic gap of the magnetic circuit. A dust cap is attached to prevent a foreign substance from entering the voice coil bobbin and the magnetic gap of the magnetic circuit. As a result, when the diaphragm and the voice coil vibrate, the diaphragm and the dust cap emit sound waves.

The shapes of the diaphragm and the dust cap influence quality and sound pressure frequency characteristics of audio reproduced by the electrodynamic speaker unit. The diaphragm and the dust cap need both of lightness and structure strength. For some of typical speakers, the shape of a cone diaphragm or a dust cap is designed to improve acoustic characteristics including smoothing of sound pressure frequency characteristics. In a circular cone diaphragm, a vibration system configuration has favorable symmetry with respect to a center axis. As a result, there is an advantage that operation failure such as rolling less occurs. On the other hand, when stiffness of the cone diaphragm is lowered, there is a problem that due to a circular shape, influence of a divided vibration mode becomes notable, and a peak dip of sound pressure frequency characteristics becomes greater. This may lead to lowering of reproduced sound quality.

For example, JP-UM-A-62-26997 as a typical technique discloses a speaker diaphragm configured such that multiple protruding ribs having a V-shaped vertical section and protruding forward or backward of the diaphragm along an inflection portion of the conical diaphragm are irregularly distributed in a direction crossing a circumferential tangent or a circumferential direction (FIGS. 2 and 3). Significant division resonance due to non-uniform stiffness of a diaphragm portion in the circumferential direction is not caused, and frequency characteristics are smoothed.

Meanwhile, Japanese Patent No. 4968139 as a typical technique discloses an insect-type flying toy blade body including a wafer-shaped silicon substrate imitating an insect shape, having a thickness of equal to or less than 1000 μm, and made of polycrystal Si, monocrystal Si, or SiC and having an outer shape imitating an insect wing. At the blade body, a recessed-raised pattern imitating an insect wing vein is formed by surface etching.

The insect wing is a thinly-extended external skeleton of a back, and is made of chitin. Moreover, the insect wing is extremely light to be suitable for flying, and has necessary strength. For supporting the wing expanded in a film shape, thick chitin strings called wing veins expand across the insect wing as in leaf veins. The insect wing veins have such a structure that the wing veins can be filled with body fluid upon eclosion to expand the wing. For example, there is study on the possibility of application to architecture by learning of geometric formation of wing veins shown in a wing of a dragonfly (Syunsuke Kudo, Motomu Uno, and Yosuke Tanaka, "Morphological Characteristics of Vein of Dragonfly and Its Potential of Architectural Applications," (Summaries of Technical Papers of Annual Meeting by Architectural Institute of Japan, Summaries of Design Works of Annual Meeting, Volume: 2012, Page: 5324), [Searched on Aug. 21, 2018], Internet <URL: https://www.rs.kagu.tus.ac.jp/unolab/thesis/2011/kudo.pdf>). Moreover, a Voronoi structure is shown in the veins of the wing of the dragonfly as the insect (Yuri Nakagawa, Ayane Hamano, and Mizuki Yamada, "Reasons why Dragonfly Wing Veins Show Voronoi Structure," (Hiroshima University High School), [Searched on Aug. 21, 2018], Internet <URL: https://www.musashino-u.ac.jp/albums/abm.php?f=abm00004627. pdf&n=%E6%9C%80%E5%84%AA%E7%A7%80%E8%B3%9E%E5%BA%83%E5%B3%B6%E5%A4%A7%E9%99%84%E5%B1%9E%E9%AB%98%E7%AD%89%E5%AD %A6%E6% A0%A1.pdf>).

The insect wing is common to the diaphragm and the dust cap of the speaker in that both of lightness and strength are necessary. Note that among typical diaphragms or dust caps configured to emit a sound wave and typical speaker units, there are no diaphragms, dust caps, and speaker units imitating, e.g., the shape or pattern of the insect wing.

The present invention has been made for solving the above-described problems of the typical techniques, and an object of the present invention is to provide a diaphragm or a dust cap configured to emit a sound wave and an electrodynamic speaker unit including the diaphragm or the dust cap. The speaker unit is configured so that a great peak dip of sound pressure frequency characteristics due to influence of a divided vibration mode can be prevented and excellent reproduced sound quality can be provided.

SUMMARY OF THE INVENTION

The diaphragm or the dust cap of the present invention is a diaphragm or a dust cap forming an electrodynamic speaker unit. A recessed-raised portion imitating a wing of an insect is formed at least on one surface of a diaphragm portion configured to emit a sound wave.

Preferably, in the diaphragm or the dust cap of the present invention, the recessed-raised portion is formed based on data obtained by measurement of an actual shape of a wing vein of the insect or data of a Voronoi diagram imitating the wing vein of the insect.

Preferably, in the diaphragm or the dust cap of the present invention, the recessed-raised portion is formed such that multiple identical wing vein shapes having a predetermined area are repeatedly arranged at the diaphragm portion.

Preferably, in the diaphragm or the dust cap of the present invention, the thickness t2 of a raised portion of the recessed-raised portion of the diaphragm portion is formed substantially equal to or greater than the thickness t1 of a recessed portion of the recessed-raised portion.

Preferably, in the diaphragm or the dust cap of the present invention, a hollow space imitating the wing vein is formed inside the raised portion of the recessed-raised portion of the diaphragm portion.

The speaker unit of the present invention includes at least the above-described diaphragm, a voice coil coupled to an inner diameter portion of the diaphragm, an edge coupled to an outer diameter portion of the diaphragm, a frame fixed to an outer peripheral end portion of the edge, and a magnetic circuit having a magnetic gap in which a coil of the voice coil is arranged and fixed to the frame.

Moreover, the speaker unit of the present invention includes at least a conical diaphragm, a voice coil coupled to an inner diameter portion of the diaphragm, the above-described dust cap coupled to the diaphragm or the voice coil, an edge coupled to an outer diameter portion of the diaphragm, a frame fixed to an outer peripheral end portion of the edge, and a magnetic circuit having a magnetic gap in which a coil of the voice coil is arranged and fixed to the frame.

Hereinafter, features of the present invention will be described.

The diaphragm or the dust cap of the present invention is the diaphragm or the dust cap forming the electrodynamic speaker unit. The recessed-raised portion imitating the wing of the insect is formed at least on one surface of the diaphragm portion configured to emit the sound wave. The recessed-raised portion is preferably formed based on the data obtained by measurement of the actual shape of the wing vein of the insect or the data of the Voronoi diagram imitating the wing vein of the insect. Awing of an insect present in nature is a structure having both of strength and lightness necessary for the insect to fly, and such a structure imitating the recessed-raised portion can exhibit a similar expected effect at the diaphragm and the dust cap.

The speaker unit of the present invention includes the diaphragm or the dust cap, the frame fixed to an outer peripheral end portion of an edge portion of the diaphragm, and the magnetic circuit having the magnetic gap in which the coil of the voice coil is arranged and fixed to the frame. The recessed-raised portion enhance stiffness of the diaphragm portion of the diaphragm or the dust cap. Thus, the speaker unit can be provided, which is configured so that a peak dip of sound pressure frequency characteristics easily emerged due to influence of a divided vibration mode can be reduced and excellent reproduced sound quality can be provided.

The recessed-raised portion of the diaphragm portion of the diaphragm or the dust cap may be formed such that the multiple identical wing vein shapes having the predetermined area are repeatedly arranged at the diaphragm portion. Even a recessed-raised portion imitating an elongated wing of an insect such as a dragonfly can be employed for a diaphragm or a dust cap having a broad circular area.

The recessed-raised portion of the diaphragm portion of the diaphragm or the dust cap is preferably configured such that the thickness t2 of the raised portion is formed substantially equal to or greater than the thickness t1 of the recessed portion of the recessed-raised portion. Moreover, the hollow space imitating the wing vein may be formed inside the raised portion of the recessed-raised portion of the diaphragm portion. The structure forming the recessed-raised portion of the diaphragm portion becomes closer to one further imitating the insect wing. Thus, the speaker unit can be provided, which is configured so that better reproduced sound quality can be provided.

The diaphragm or the dust cap and the electrodynamic speaker unit including the diaphragm or the dust cap according to the present invention can provide a speaker unit configured so that a great peak dip of sound pressure frequency characteristics due to influence of a divided vibration mode can be prevented and excellent reproduced sound quality can be provided.

DETAILED DESCRIPTION OF THE PREFERRED EMBODIMENTS

Hereinafter, a diaphragm or a dust cap and a speaker unit according to preferred embodiments of the present invention will be described, but the present invention is not limited to these embodiments.

First Embodiment

Figure 1:
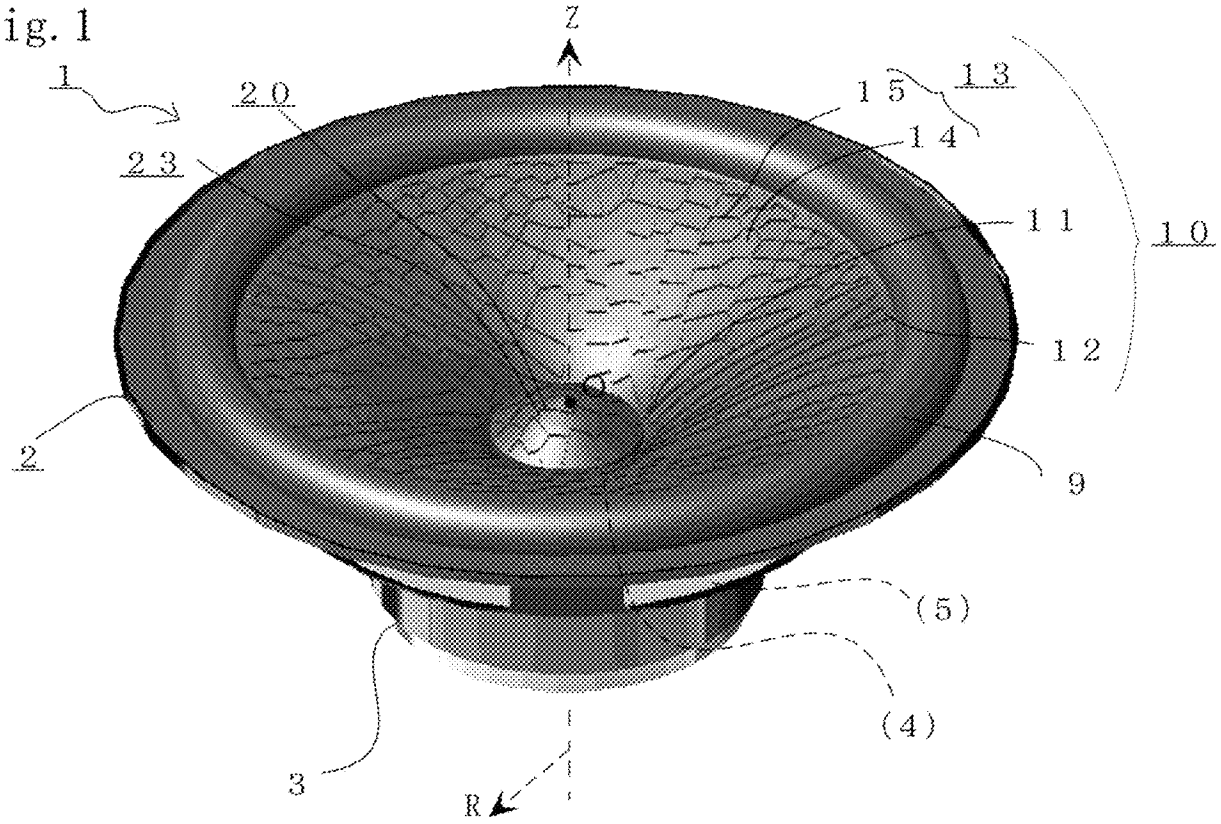
FIG. 1 is an external view of an electrodynamic speaker unit according to one embodiment of the present invention.

FIG. 1 is a view for describing an electrodynamic speaker unit 1 according to a preferred embodiment of the present invention. Specifically, FIG. 1 is a perspective view of an outer appearance of the speaker unit 1 including a cone diaphragm and a dust cap from a front side. Note that the form of the speaker unit 1 is not limited to the case of the present embodiment. Moreover, configurations of the speaker unit 1 unnecessary for description of the present invention are not shown in the figures, and are not described.

The speaker unit 1 of the present embodiment is an electrodynamic speaker for a speaker system or vehicle attachment, the electrodynamic speaker having a nominal diameter of 16 cm. The speaker unit 1 is attached to, e.g., a cabinet forming the speaker system or a body/door of a vehicle to form a speaker configured to reproduce audio. Note that, e.g., a specific form of the speaker system using the speaker unit 1 is not shown in the figures, and is not described.

The speaker unit 1 includes a basket-shaped frame 2 made of a metal material, a magnetic circuit 3 fixed to the frame 2, a conical diaphragm 10 formed by papermaking of a paper material, a (not-shown) voice coil 4 coupled to an inner peripheral side of the diaphragm 10 and having a coil arranged in a (not-shown) magnetic gap of the (not-shown) magnetic circuit 3, a (not-shown) damper 5 coupled to and vibratably supporting a (not-shown) bobbin of the voice coil 4, an edge 9 coupled to an outer peripheral side of the diaphragm 10 and vibratably supporting the diaphragm 10, and a dust cap 20 attached to close an upper end side of the (not-shown) bobbin of the voice coil 4. Note that the voice coil 4 and the damper 5 are positioned and hidden on a back side of the diaphragm 10 in FIG. 1, and therefore, outer appearances thereof are not shown.

Thus, in the speaker unit 1, when audio signal current is supplied to the coil of the voice coil 4 arranged in the magnetic gap of the magnetic circuit 3 generating a strong DC field, drive force is generated in an illustrated Z-axis direction, and a speaker vibration system including the voice coil 4, the diaphragm 10, and the dust cap 20 is driven in the Z-axis direction. That is, the speaker vibration system is vibratably supported by the damper 5 and the edge 9. As a result, a pressure change occurs in air present in the front and back of the diaphragm 10 and the dust cap 20, and the audio signal current is converted into a sound wave (audio).

Figure 2:
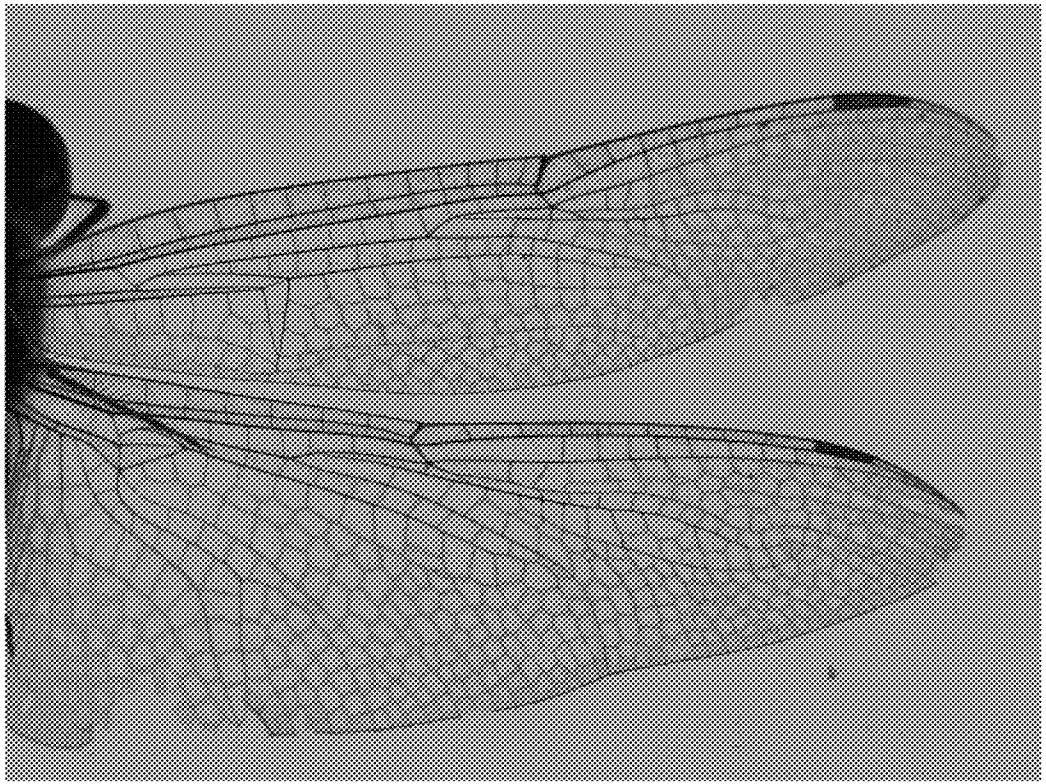
FIG. 2 is a view for describing veins/a recessed-raised portion of wings of an insect.

FIG. 2 is a view for describing veins/a recessed-raised portion of wings of an insect. Specifically, FIG. 2 is a partially-enlarged photograph of wings of a certain dragonfly. A light source is placed on a back side of the wings, and therefore, wing veins are shown as thick shadow lines due to light transmitted through the wings. In the wing of the insect, a thin film is formed in each region surrounded by the wing veins, and the thickness of the film as a recessed portion has a structure thinner than the thickness of the wing vein as a raised portion. There are various ways to expand veins of a wing of natural insects according to a type/individual. However, these ways are common to each other in that the recessed-raised portion as in FIG. 2 is formed.

The recessed-raised portion of the wing of the insect can be imitated based on data obtained by measurement of the shape of a wing vein of an actual insect. For example, the position of an intersection between the wing veins is specified from the photograph of FIG. 2, and is converted into data. These intersections are connected to each other so that the recessed-raised portion imitating actual wing veins can be reproduced. In the actual wing veins, a distance between the wing vein intersections varies. The wing veins form such a recessed-raised portion that different many polygons (mainly a triangle, a rectangle, or a pentagon) having various sizes and shapes are connected to each other. The recessed-raised portion of the wing veins achieves a structure having strength and lightness necessary as the wing for the insect to fly.

Note that the dimensions of the recessed-raised portion utilized for the diaphragm or the dust cap are not limited to those coincident with actual insect wing vein dimensions, and it is practical that these dimensions are enlarged several times upon utilization. Since an actual insect wing area is small, it is suitable to enlarge, upon utilization, the dimensions with the relative ratio of the size of the recessed-raised portion being held. The same wing vein shapes having a predetermined area may be repeatedly arranged and formed as a recessed-raised portion for reinforcing a diaphragm portion of the diaphragm or the dust cap. Note that the recessed-raised portion formed by the veins of the wing of the insect may be utilized such that vein portions are thick raised portions and film portions surrounded by the wing veins are thin recessed portions, and a thick dimension is not necessarily accurately imitated.

Figures 3A, 3B, 3C:
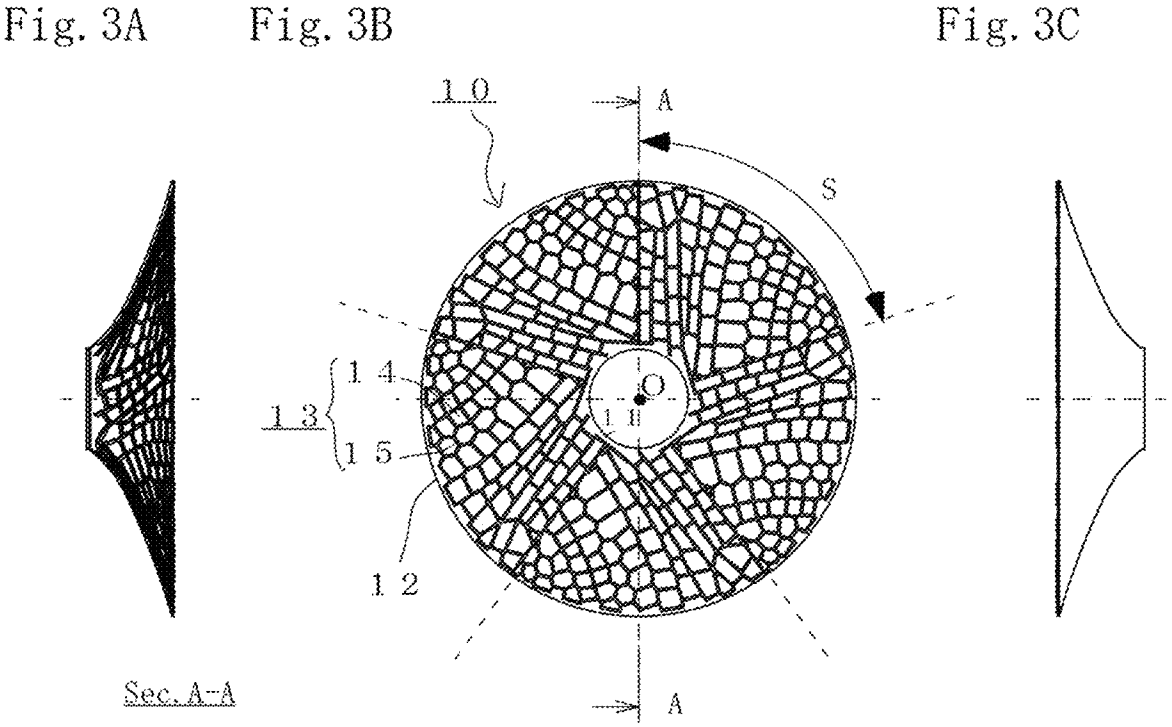
FIGS. 3A, 3B, and 3C are views of the shape of a diaphragm according to one embodiment of the present invention.

FIGS. 3A to 3C are views of the shape of the diaphragm 10 according to one embodiment of the present invention. Specifically, FIG. 3B is a plan view of the diaphragm 10, FIG. 3A is an A-A sectional view of the diaphragm 10, and FIG. 3C is a side view of the diaphragm 10. The conical diaphragm 10 has an inner diameter portion 11 defining a circular hole, an outer diameter portion 12 defining a circular edge portion as a circle concentric with the inner diameter portion 11, and a diaphragm portion 13 having a substantially conical curved surface connecting the inner diameter portion 11 and the outer diameter portion 12.

The recessed-raised portion imitating the wing of the insect is formed on one surface of the curved surface of the diaphragm portion 13 of the diaphragm 10 of the present embodiment. The recessed-raised portion includes, as in the recessed-raised portion of the wing of the insect, thin recessed portions 14 (a thickness t1) and thick raised portions 15 (a thickness t2 (>t1)). In the case of the diaphragm 10 of the present embodiment, five recessed-raised portions in a substantially fan-shaped region S at an angle of 72° about the center O are repeatedly arranged in a circumferential direction to form the recessed-raised portion across the entire circumference as illustrated in FIG. 3B. Thus, the recessed portions 14 and the raised portions 15 form a rib-shaped structure similar to that of the veins of the wing at the substantially conical curved surface of the diaphragm portion 13. The recessed-raised portion formed by the recessed portions 14 and the raised portions 15 acts to enhance stiffness of the diaphragm portion 13.

Note that the diaphragm 10 of the present embodiment is configured such that the recessed-raised portion is formed only on one side of the curved surface of the diaphragm portion 13, but the recessed-raised portions may be formed on both sides. In this case, the thin recessed portions may be formed on one side to correspond to the raised portions 15 on the other side of the curved surface of the diaphragm portion 13 to shape the wing veins, and the thickness t2 of the raised portion 15 may be substantially the same as the thickness t1 of the broad recessed portion 14. Alternatively, on both sides of the curved surface of the diaphragm portion 13, the raised portions 15 thickly protruding as compared to the thickness t1 of the recessed portion 14 may be provided. Alternatively, the recessed-raised portion may not necessarily be provided across the entirety of the curved surface of the diaphragm portion 13, but be partially provided.

Figures 4A, 4B, 4C:
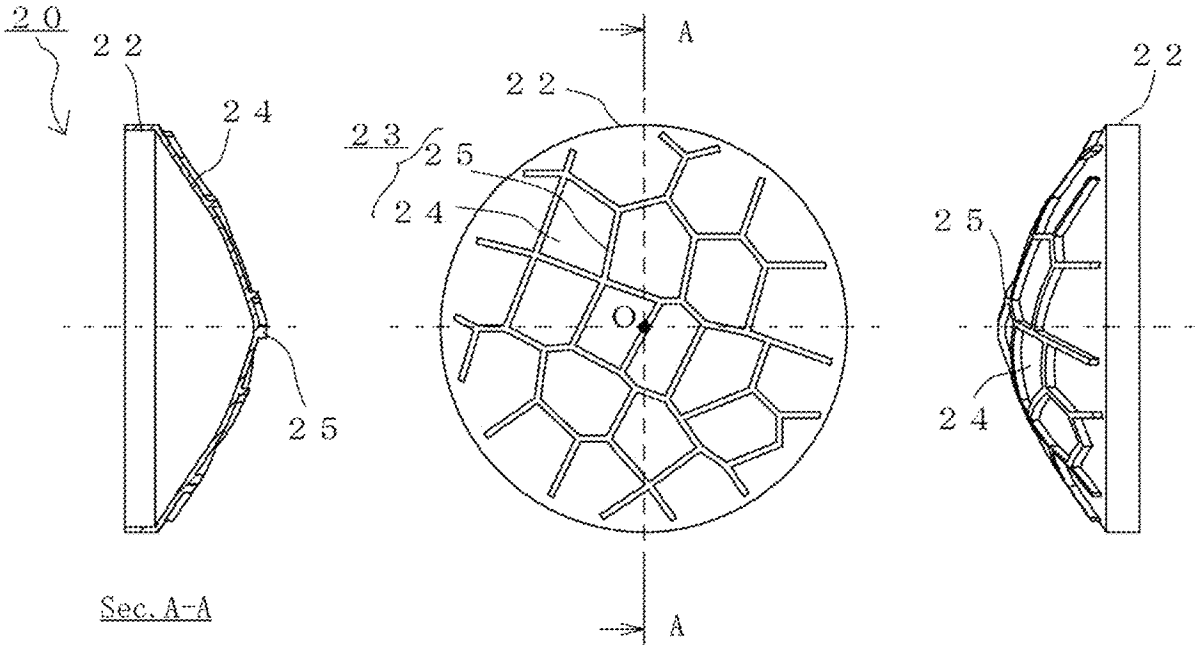
FIGS. 4A, 4B, and 4C are views of a dust cap according to one embodiment of the present invention.

FIGS. 4A to 4C are views of the shape of the dust cap 20 according to one embodiment of the present invention. Specifically, FIG. 4B is a plan view of the dust cap 20, FIG. 4A is an A-A sectional view of the dust cap 20, and FIG. 4C is a side view of the dust cap 20. The dust cap 20 has an outer diameter portion 22 defining a circular edge portion, and a substantially dome-shaped diaphragm portion 23.

The recessed-raised portion imitating the wing of the insect is formed on one side of a curved surface of the diaphragm portion 23 of the dust cap 20 of the present embodiment. As in the recessed-raised portion of the wing of the insect, this recessed-raised portion includes thin recessed portions 24 (a thickness t3) and thick raised portions 25 (a thickness t4 (>t3)). In the case of the dust cap 20 of the present embodiment, an area is narrower than that of the diaphragm 10, and therefore, the recessed-raised portion imitating the wing of the insect is directly arranged on one surface. Thus, the recessed portions 24 and the raised portions 25 form a rib-shaped structure similar to that of the veins of the wing on the dome-shaped curved surface of the diaphragm portion 23. The recessed-raised portion formed by the recessed portions 24 and the raised portions 25 acts to enhance stiffness of the diaphragm portion 23.

Note that the dust cap 20 of the present embodiment is configured such that the recessed-raised portion is formed only on one side of the curved surface of the diaphragm portion 23, but the recessed-raised portions may be formed on both sides. In this case, the thin recessed portions may be formed on one side to correspond to the raised portions 25 on the other side of the curved surface of the diaphragm portion 23 to shape the wing veins, and the thickness t4 of the raised portion 25 may be substantially the same as the thickness t3 of the broad recessed portion 24. Alternatively, on both sides of the curved surface of the diaphragm portion 23, the raised portions 25 thickly protruding as compared to the thickness t3 of the recessed portion 24 may be provided. Alternatively, the recessed-raised portion may not necessarily be provided across the entirety of the curved surface of the diaphragm portion 23, but be partially provided.

Figure 5:
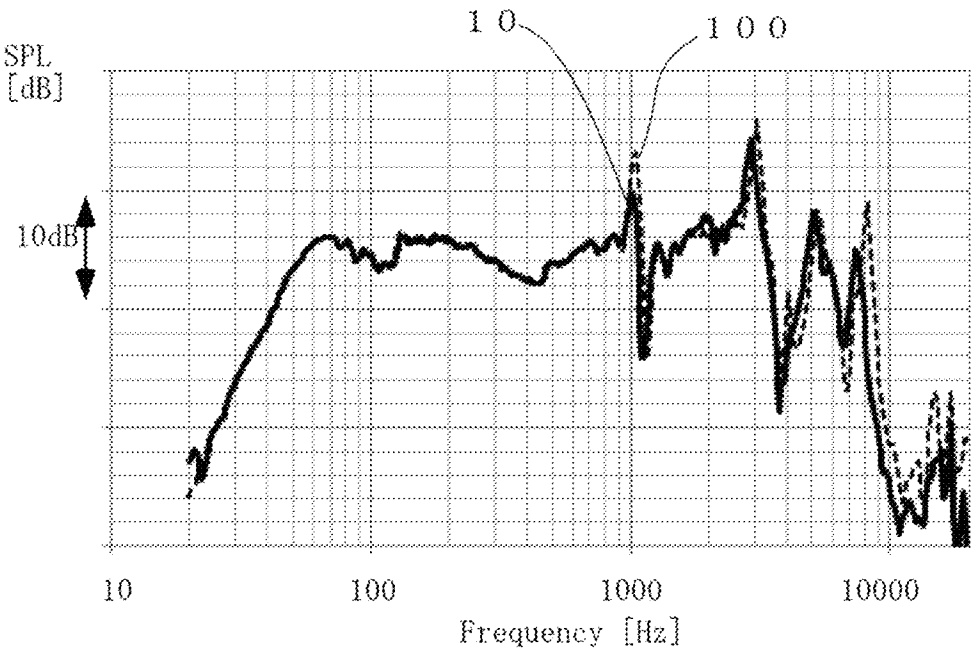
FIG. 5 is a graph of sound pressure frequency characteristics of the electrodynamic speaker unit using the diaphragm and the dust cap according to one embodiment of the present invention and a speaker unit of a comparative example.

FIG. 5 is a graph of sound pressure frequency characteristics of the electrodynamic speaker unit 1 using the diaphragm 10 and the dust cap 20 according to the present embodiment and a speaker unit 100 of a (not-shown) comparative example. The speaker unit 100 of the comparative example is different in that the speaker unit 100 includes a diaphragm and a dust cap of the (not-shown) comparative example not having recessed-raised portions imitating a wing of an insect, and therefore, is not described and not shown in the figure.

As illustrated in FIG. 5, in the speaker unit 1 of the present embodiment using the diaphragm 10 and the dust cap 20, the recessed-raised portions of the diaphragm 10 and the dust cap 20 enhance the stiffness of the diaphragm portion 13 and the diaphragm portion 23. Thus, a peak dip of the sound pressure frequency characteristics easily emerged due to influence of a divided vibration mode is reduced, and excellent reproduced sound quality is provided. On the other hand, in the speaker unit 100 of the comparative example including the diaphragm and the dust cap of the comparative example not having the recessed-raised portions, stiffness of diaphragm portions is lower, and therefore, the influence of the divided vibration mode is easily emerged as the peak dip of the sound pressure frequency characteristics.

Note that the recessed-raised portions of the diaphragm 10 and the dust cap 20 of the present embodiment are formed based on the data obtained by measurement of the shape of the wing veins of the actual dragonfly. Note that the recessed-raised portion is not limited to the dragonfly, and may imitate wings of other insects such as a cicada, a butterfly, a beetle, and a lady beetle.

Based on consideration that the recessed-raised portion of the wing of the insect has similarity to a Voronoi diagram, the recessed-raised portion imitating the wing veins of the insect can be produced from data of a produced Voronoi diagram. The Voronoi diagram is a diagram obtained in such a manner that some points (mother points) are taken on a plane and are connected by lines to draw a figure, perpendicular bisectors of sides of formed triangles are connected to draw a figure, and the initially-produced lines are eliminated. The Voronoi diagram can be also taken as a diagram obtained in such a manner that mother points arranged on a plane are divided according to the proximity to other mother points. Thus, the perpendicular bisectors connected in the Voronoi diagram are used so that the recessed-raised portion imitating the wing veins of the insect can be drawn. The recessed-raised portion may be formed based on data of a Voronoi diagram imitating the wing veins of the insect.

In the wing veins forming the recessed-raised portion of the wing of the insect, body fluid flows only upon stretching out of the wing. After the wing has been formed, the wing veins in which the body fluid has flowed become dry and empty. This contributes to the structure having both of strength and lightness necessary for the wing. Thus, in the diaphragm 10 or the dust cap 20 having the recessed-raised portion imitating the wing of the insect according to the present invention, a hollow space imitating the wing veins of the insect may be formed inside.

For example, in the recessed-raised portion of the diaphragm portion 13 imitating the wing of the insect, the density of a diaphragm material in the thick raised portion 15 may be lower than the density of a diaphragm material of the thin recessed portion 14. Moreover, in a diaphragm formed by bonding of a front material and a back material, the diaphragm may be formed such that thin recessed portions 14 are bonded to each other and a hollow space in which the front material and the back material are not bonded to each other is provided inside the thick raised portions 15.

Moreover, a material forming the diaphragm 10 or the dust cap 20 of the present embodiment may be a resin material. For example, the resin material forming the diaphragm 10 or the dust cap 20 may be a PET film-shaped member. The material forming the diaphragm 10 or the dust cap 20 may be, for example, other lightweight resin material films such as polyetheretherketone (PEEK), polyetherimide (PEI), polyethylenenaphthalate (PEN), polycarbonate (PC), polyimide (PI), polyarylate (PAR), and polyphenylene sulfide (PPS), materials formed by hot pressing of sheets, and materials formed by pressing of elastomer sheets. Alternatively, the material forming the diaphragm 10 or the dust cap 20 may be non-woven fabric made of natural fibers such as cellulose or synthetic fibers, or paper materials.

Further, the diaphragm 10 of the present invention may be a dome-shaped diaphragm configured to emit a sound wave as in the dust cap 20. In addition, regardless of a diaphragm nominal diameter and a diaphragm shape, the diaphragm of the present invention may be a balance dome-shaped diaphragm formed by combination of a dome-shaped diaphragm and a conical diaphragm. Needless to say, the diaphragm may be a conical diaphragm configured such that a dust cap portion is integrally formed. Moreover, the dust cap may be one including a sub-cone as a diaphragm.

The diaphragm of the present invention is not limited to the illustrated electrodynamic speaker unit, and may be a speaker unit forming a speaker vibration system without a damper. Moreover, the diaphragm of the present invention is not limited to the electrodynamic speaker unit, and is also applicable to a piezoelectric speaker unit.

What is claimed is:

1. A diaphragm or a dust cap forming an electrodynamic speaker unit, wherein a recessed-raised portion imitating a wing of an insect is formed at least on one surface of a diaphragm portion configured to emit a sound wave, and the recessed-raised portion is formed based on data obtained by measurement of an actual shape of a wing vein of the insect or data of a Voronoi diagram imitating the wing vein of the insect.

2. The diaphragm or the dust cap according to claim 1, wherein the recessed-raised portion is formed such that multiple identical wing vein shapes having a predetermined area are repeatedly arranged at the diaphragm portion.

3. The diaphragm or the dust cap according to claim 1, wherein a thickness t2 of a raised portion of the recessed-raised portion of the diaphragm portion is formed substantially equal to or greater than a thickness t1 of a recessed portion of the recessed-raised portion.

4. The diaphragm or the dust cap according to claim 3, wherein a hollow space imitating the wing vein is formed inside the raised portion of the recessed-raised portion of the diaphragm portion.

5. A speaker unit comprising at least:

a diaphragm forming an electrodynamic speaker unit;

a voice coil coupled to an inner diameter portion of the diaphragm;

an edge coupled to an outer diameter portion of the diaphragm;

a frame fixed to an outer peripheral end portion of the edge; and a magnetic circuit having a magnetic gap in which a coil of the voice coil is arranged and fixed to the frame, wherein;

a recessed-raised portion imitating a wing of an insect is formed at least on one surface of a diaphragm portion configured to emit a sound wave, and the recessed-raised portion is formed based on data obtained by measurement of an actual shape of a wing vein of the insect or data of a Voronoi diagram imitating the wing vein of the insect.

6. A speaker unit comprising at least:

a conical diaphragm;

a voice coil coupled to an inner diameter portion of the diaphragm;

a dust cap forming an electrodynamic speaker unit, the dust cap being coupled to the diaphragm or the voice coil;

an edge coupled to an outer diameter portion of the diaphragm;

a frame fixed to an outer peripheral end portion of the edge; and a magnetic circuit having a magnetic gap in which a coil of the voice coil is arranged and fixed to the frame, wherein a recessed-raised portion imitating a wing of an insect is formed at least on one surface of a diaphragm portion configured to emit a sound wave, and the recessed-raised portion is formed based on data obtained by measurement of an actual shape of a wing vein of the insect or data of a Voronoi diagram imitating the wing vein of the insect.

* * * * *